US008197152B2

(12) United States Patent
Wu

(10) Patent No.: US 8,197,152 B2
(45) Date of Patent: Jun. 12, 2012

(54) LIQUID DISPENSER

(76) Inventor: Shang Chuan Wu, Chang-Hwa (TW)

( * ) Notice: Subject to any disclaimer, the term of this patent is extended or adjusted under 35 U.S.C. 154(b) by 520 days.

(21) Appl. No.: 12/583,874

(22) Filed: Aug. 27, 2009

(65) Prior Publication Data

US 2011/0052309 A1 Mar. 3, 2011

(51) Int. Cl.
*A47L 13/30* (2006.01)
*B43K 5/18* (2006.01)
*B43M 11/06* (2006.01)

(52) U.S. Cl. ..... 401/263; 401/279; 401/216

(58) Field of Classification Search ..... 401/279, 401/278, 277, 270, 232, 205, 206, 263, 214, 401/216; 222/631, 20, 409, 344, 359, 336, 222/310, 434
See application file for complete search history.

(56) References Cited

U.S. PATENT DOCUMENTS 5,137,388 A * 8/1992 Kimura ..... 401/278
5,971,227 A * 10/1999 White et al. ..... 222/333
6,200,055 B1 * 3/2001 Fusaro, Jr. ..... 401/178
6,533,482 B1 * 3/2003 Byun ..... 401/180
6,896,433 B1 5/2005 Zhang et al.
7,175,359 B2 2/2007 Zhang et al.
7,226,231 B2 * 6/2007 Py et al. ..... 401/266
7,883,287 B2 * 2/2011 Thorpe ..... 401/266
2007/0017936 A1 * 1/2007 Allsop ..... 222/402.2

* cited by examiner

*Primary Examiner* — David J. Walczak
*Assistant Examiner* — Jennifer C Chiang
(74) *Attorney, Agent, or Firm* — Charles E. Baxley

(57) ABSTRACT

A liquid dispenser includes a hollow shank, a dispensing head longitudinally mounted to a first end of the hollow shank, a control device longitudinally mounted to a second end of the hollow shank and a sheath detachably mounted to the first end of the hollow shank for protecting the dispensing head after use. A passage is defined in one end of the hollow shank for communicating with an inner periphery of the hollow shank and the dispensing head such that the liquid contained in the hollow shank can flow into the dispensing head. The control device is provided to selectively close/open the passage for controlling the output quantity of the liquid dispenser.

12 Claims, 10 Drawing Sheets

LIQUID DISPENSER

BACKGROUND OF THE INVENTION

1. Field of the Invention

The present invention relates to a liquid dispenser, and more particularly to a liquid dispenser that outputs liquid in a fixed quality for every operation.

2. Description of Related Art

A conventional cosmeticizing pen, U.S. Pat. No. 6,896,433, includes a sleeve and a guider partially received in the sleeve, a first cylinder and a second cylinder respectively longitudinally mounted to two opposite ends of the guider for containing two different cosmetics. A first head and a second are respectively mounted to a free end of each of the first cylinder and the second cylinder. A first cap and a second cap are respectively mounted to the first head and the second head for protect the first head and the second head after use. A first drive set and a second drive set respectively mounted in the first cylinder and the second cylinder. There are multiple threaded elements disposed in the conventional cosmeticizing pen for squeezing and outputting the cosmetic in the first/second cylinder.

However, the output quality of the conventional liquid dispenser is unfixed because the user can not precisely control the moving rate of the threaded elements every time when squeezing and outputting the cosmetic in the first/second cylinder. As a result, the output liquid either be insufficient or be wasted. It needs to be advantageously altered.

The present invention has arisen to mitigate and/or obviate the disadvantages of the conventional cosmeticizing pen.

SUMMARY OF THE INVENTION

The main objective of the present invention is to provide an improved liquid dispenser that outputs liquid in a fixed quality for every operation.

To achieve the objective, the liquid dispenser in accordance with the present invention comprises a hollow shank for containing liquid. The hollow shank has a first end that is closed and a second end that is open. A first tapered hole is centrally defined in the first end of the hollow shank and communicates with an inner periphery of the hollow shank. A connector co-axially and outwardly extends from the first end of the hollow shank. A second tapered hole is longitudinally defined in the connector and communicating with the first tapered hole. An annular rib inward extends from a distal edge of the second tapered hole. Multiple slots are radially defined in a free end of the connector and communicate with the second tapered hole. A steel ball is movably received in the second tapered hole for selectively closing the second tapered hole and has a diameter greater than an inner diameter of the annular rib to prevent the steel ball from detaching from the connector. A dispensing head is longitudinally mounted to the connector for dispensing liquid from the hollow shank. The dispensing head includes an engaging portion sleeved on the connector and a connecting portion longitudinally extending from the engaging portion for mounting a dispensing element. A control device is longitudinally mounted to the second end of the hollow shank for selectively opening/closing the first tapered hole. A sheath detachably mounted to the first end of the hollow shank for protecting the dispensing head after use.

Further benefits and advantages of the present invention will become apparent after a careful reading of the detailed description with appropriate reference to the accompanying drawings.

DETAILED DESCRIPTION OF THE INVENTION

Figure 1:
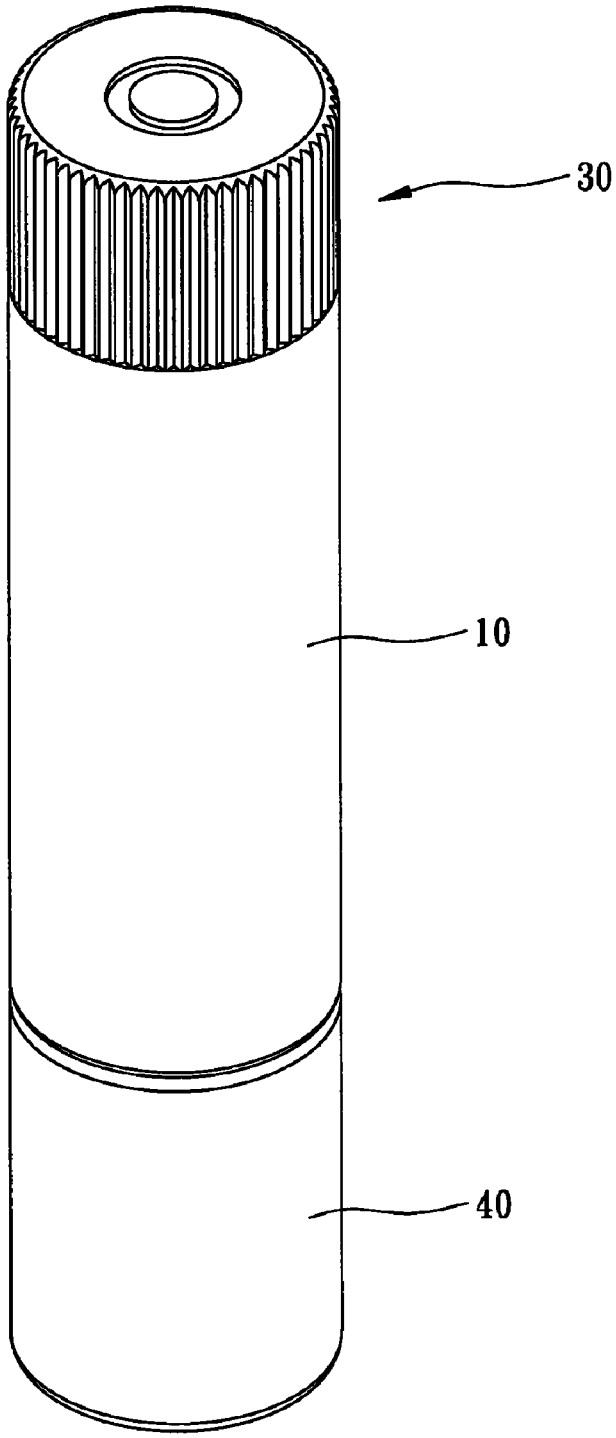
FIG. 1 is a perspective view of a liquid dispenser in accordance with the present invention.
Figure 2:
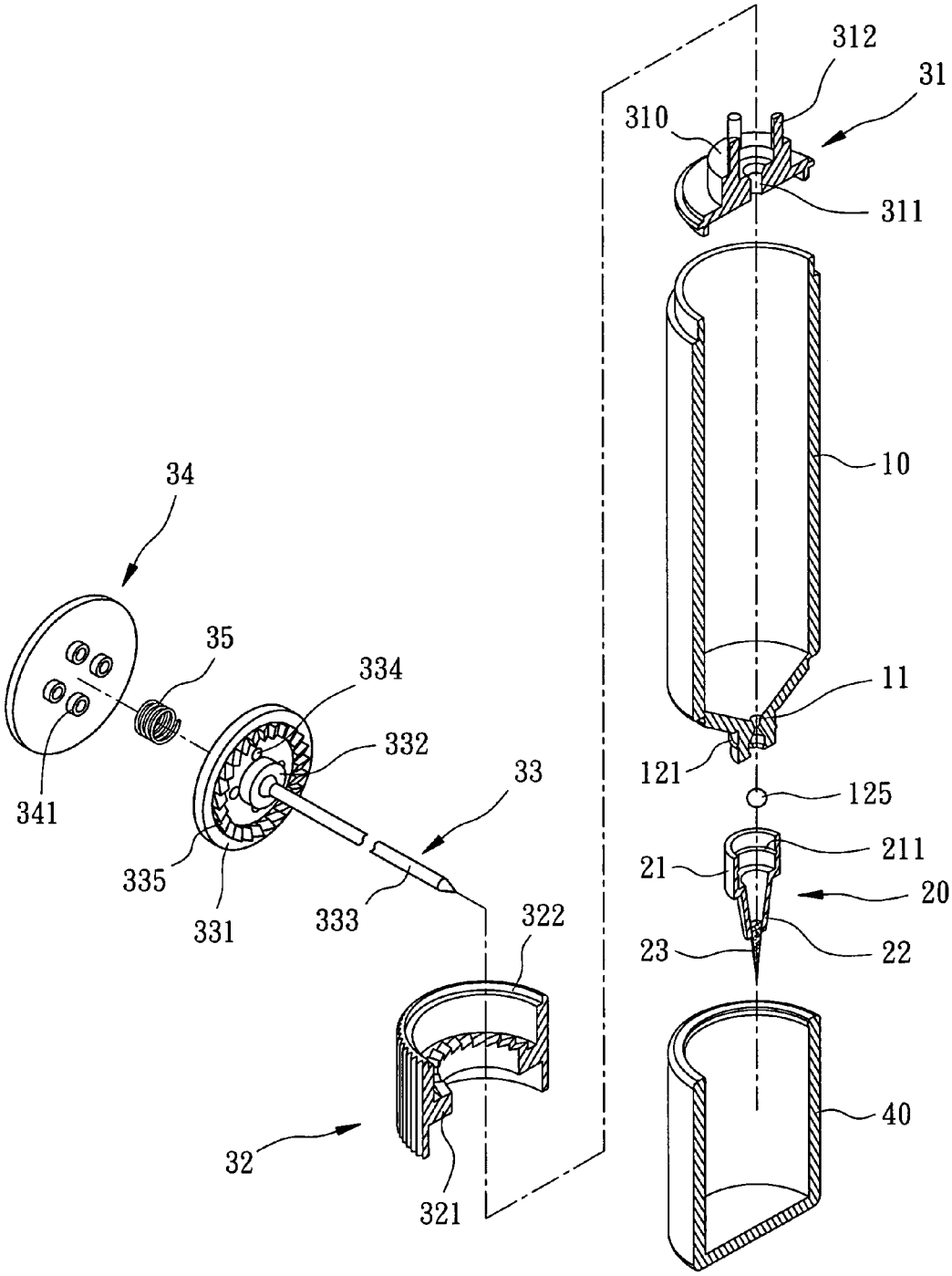
FIG. 2 is an exploded perspective view of the liquid dispenser in FIG. 1.
Figure 3:
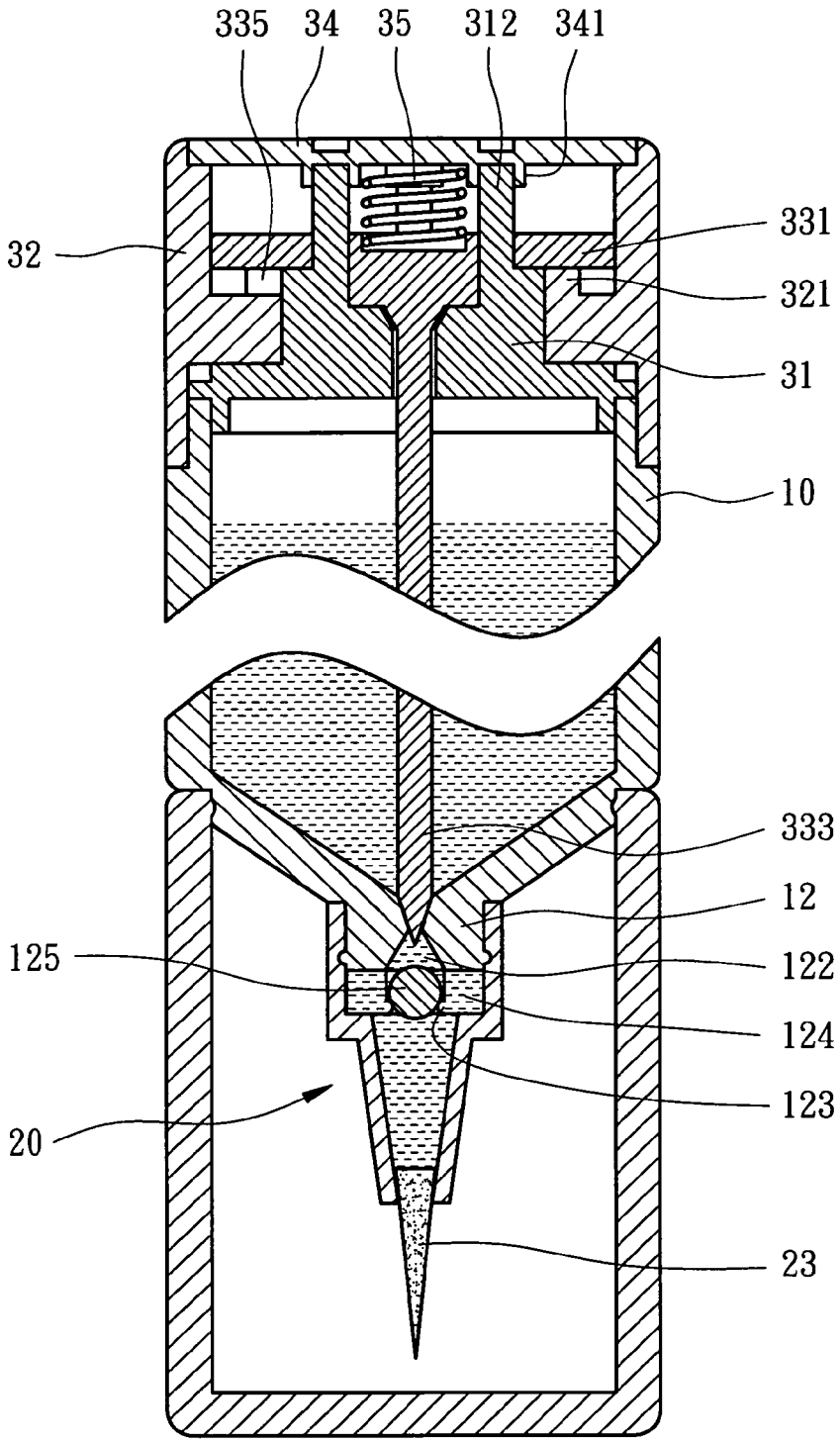
FIG. 3 is a cross-sectional view of the liquid dispenser in FIG. 1.

Referring to the drawings and initially to FIGS. 1-3, a liquid dispenser in accordance with the present invention comprises a hollow shank (10), a dispensing head (20) longitudinally mounted to a first end of the hollow shank (10), a control device (30) longitudinally mounted to a second end of the hollow shank (10) and a sheath (40) detachably mounted to the first end of the hollow shank (10) for protecting the dispensing head (20) after use.

The hollow shank (10) is provided for containing liquid, and the first end of the hollow shank (10) is a closed end and the second end of the hollow shank (10) is an open end. A first tapered hole (11) is centrally defined in the first end of the hollow shank (10) and communicating with an inner periphery of the hollow shank (10). A connector (12) co-axially and outwardly extends from the first end of the hollow shank (10). A first annular rib (121) is formed on an outer periphery of the connector (12) and a second tapered hole (122) is centrally defined in the connector (12). The second tapered hole (122) communicates with the first tapered hole (11) to form a sand-glass-shaped passage in the connector (12). A second annular rib (123) inward extends from a distal edge of the second tapered hole (122). Multiple slots (124) are radially defined in a free end of the connector (12) and respectively communicate with the second tapered hole (122). A steel ball (125) is movably received in the second tapered hole (122). The steel ball (125) has a diameter greater than an inner diameter of the second annular rib (123) to prevent the steel ball (125) from detaching from the connector (12).

The dispensing head (20) is provided to selectively dispensing liquid from the hollow hank (10) relative to the control device (30). The dispensing head (20) includes an engaging portion (21) sleeved on the connector (12) and a connecting portion (22) longitudinally extending from the engaging portion (21) for mounting a dispensing element (23). An annular groove (211) is defined in an inner periphery of the engaging portion (21) for receiving the first annular rib (121). The dispensing element (23) is selected from brush, writing brush and foam material relative to the liquid that is contained in the hollow shank (10).

The control device (30) includes a guider (31) co-axially mounted to the second end of the hollow shank (10) and airtightly closing the second end of the hollow shank (10). The guider (31) has a protrusion (310) centrally extending therefrom opposite to the hollow shank (10). A T-shaped hole (311) is centrally defined in the guider (31) and extends through the guider (31). The T-shaped hole (311) includes a first section and a second section, wherein the first section has a diameter greater than that of the second section. Multiple rods (312) perpendicularly extend from the protrusion (310) and correspond to an axis of the guider (31).

A drive ring (32) is longitudinally and rotatably mounted to the second end of the hollow shank (10). A first ratchet ring (321) radially extends from an inner periphery of the drive ring (32) and surrounds the protrusion (310). An annular groove (322) is defined in a distal end of the drive ring (32) opposite to the hollow shank (10).

A pusher (33) is longitudinally mounted to the guider (31). The pusher (33) has a disk (331) co-axially received in the drive ring (32), wherein the drive ring (32) is rotatable relative to the disk (331). A block (332) centrally extends from the disk (331) and is movably received in the first section of the T-shaped hole (311). A needle (333) centrally extends from the block (332) and extends through the second section of the T-shaped hole (311). The needle (333) is formed with a tapered free end that is selectively received in the first tapered hole (11) for closing the passage that is defined in the first end of the hollow shank (10). The disk (331) has multiple through holes (334) defined therein and surrounding the block (332). Each through hole (334) aligns with a corresponding one of the multiple rods (312) to allow the multiple rods (312) extending through the disk (331) such that the disk (331) can only be longitudinally moved relative to the guider (31). A second ratchet ring (335) is formed on the disk (331) and complementally engaged with the first ratchet ring (321).

A cover (34) is mounted to a free end of each of the multiple rods (312) and received in the annular groove (322) in the drive ring (32) to prevent the drive ring (32) and the pusher (33) from detaching from the guider (31). Multiple hollow stubs (341) extend from one side of the cover (34) and each hollow stub (341) receives a free end of a corresponding one of the multiple rods (312).

A resilient member (35) is pre-compressively mounted between the disk (331) and the cover (43). The resilient member (365) ensures that the first ratchet ring (321) and the second ratchet ring (335) are complementally engaged with each other, and the tapered free end of the needle (333) is received in the first tapered hole (11) for closing the first end of the hollow shank (10) before the drive ring (32) being rotated. In the preferred embodiment of the present invention, the resilient member (35) is a compression spring.

Figure 4:
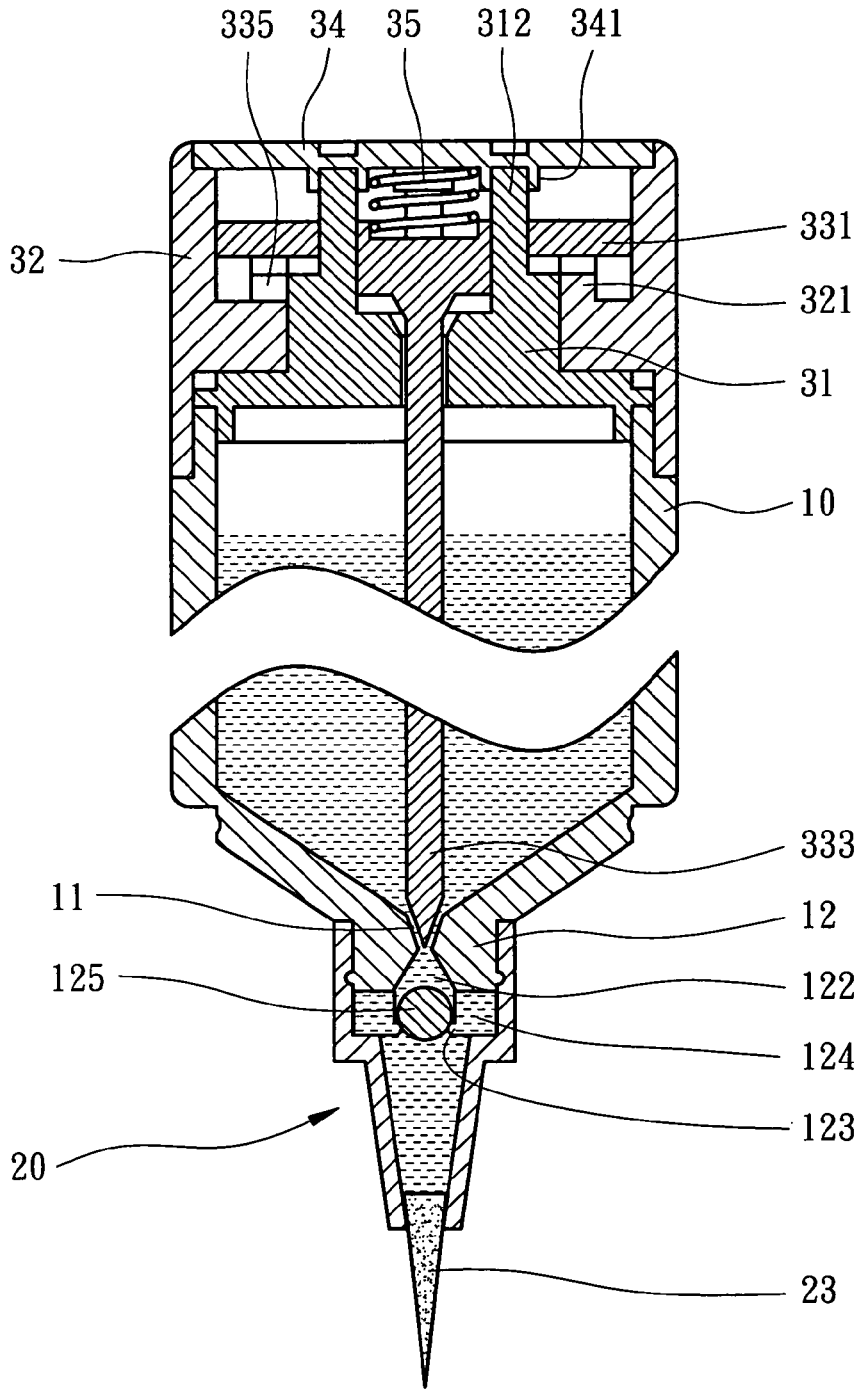
FIG. 4 is an operational view of the liquid dispenser in accordance with the present invention.

With reference to FIGS. 3 and 4, the disk (331) is moved toward the cover (34) along the multiple rods (312) due to the engaged first ratchet ring (321) and the second ratchet ring (335) when the drive ring (32) is rotated relative to the engaging direction of the first ratchet ring (321). At the same time, the tapered free end of the needle (333) is separated from the first tapered hole (11) and the air flows into the hollow shank (10) via the T-shaped hole (311) in the guider (31). As a result, the liquid, in the hollow shank (10), flows into the dispensing head (20) via the first tapered hole (11), the second tapered hole (122) and the slots (124). Finally, the liquid is output by the dispensing element (23). The first ratchet ring (321) and the second ratchet ring (335) are engaged with each other again, as shown in FIG. 3 due to the restitution force of the resilient member (35) when the drive ring (32) is moved over a circumferential angle of a ratchet of each of the first ratchet ring (321) and the second ratchet ring (335). At the same time, the first tapered hole (11) is closed again by the needle (33).

As described above, the liquid dispenser in accordance with the present invention can outputs liquid in a fixed quality for every operation due to the engaging relation between the first ratchet ring (321) and the second ratchet ring (335).

Figure 5:
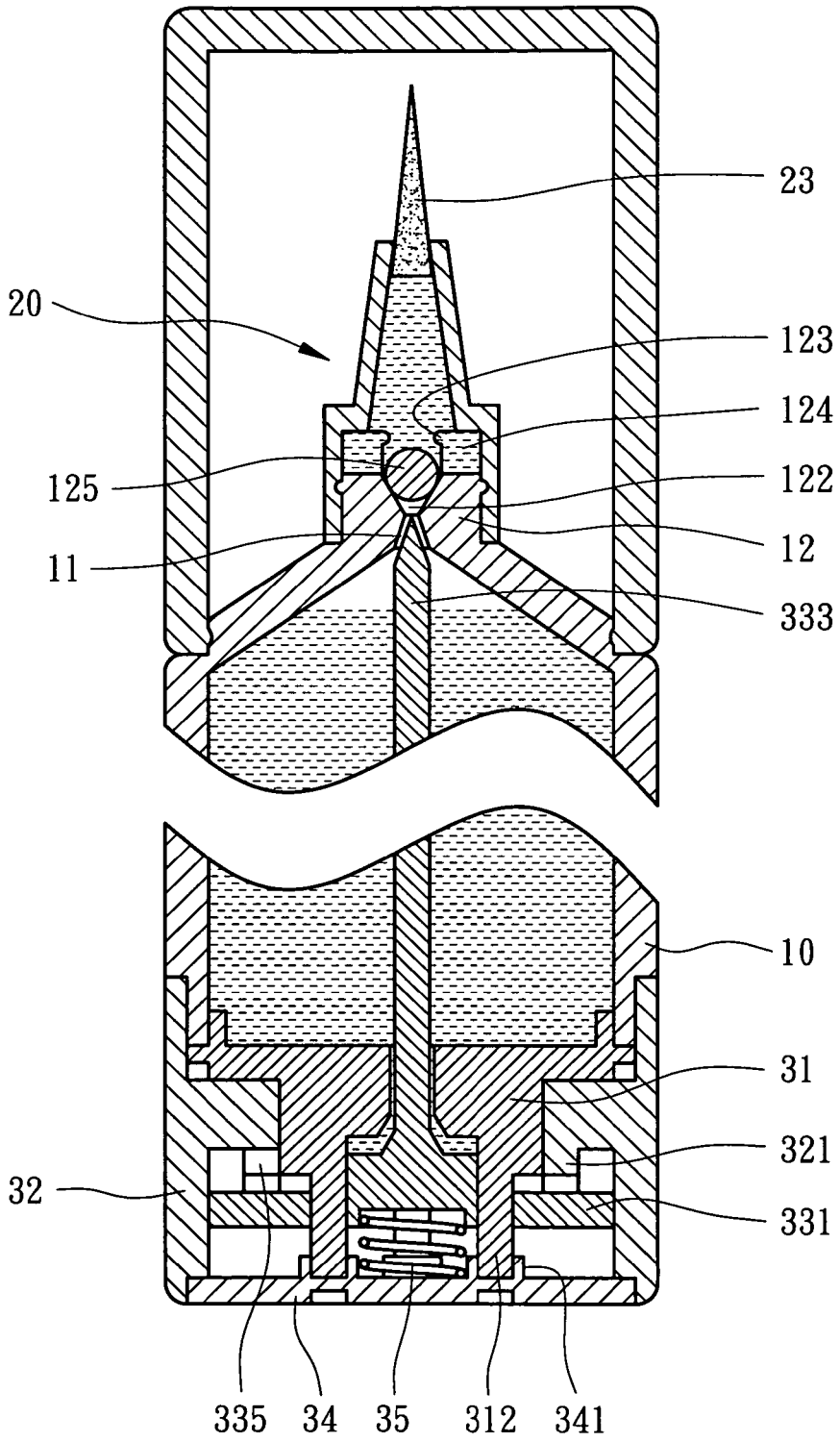
FIG. 5 is another operational view of the liquid dispenser in accordance with the present invention when the liquid dispenser is reversed.

With reference to FIG. 5, the steel ball (125) abuts against an inner periphery of the second tapered hole (122) to close the passage defined in the first end of the hollow shank (10) when the hollow shank (10) is reversed and the control device (30) is operated in error. Consequently, the remained liquid in the dispensing head (20) can not flow back into the hollow shank (10) and the remained liquid in the hollow shank (10) can not flow out of the hollow shank (10) via the T-shaped hole (311) in the guider (31) because the air can not flow into the hollow shank (10).

Figure 6:
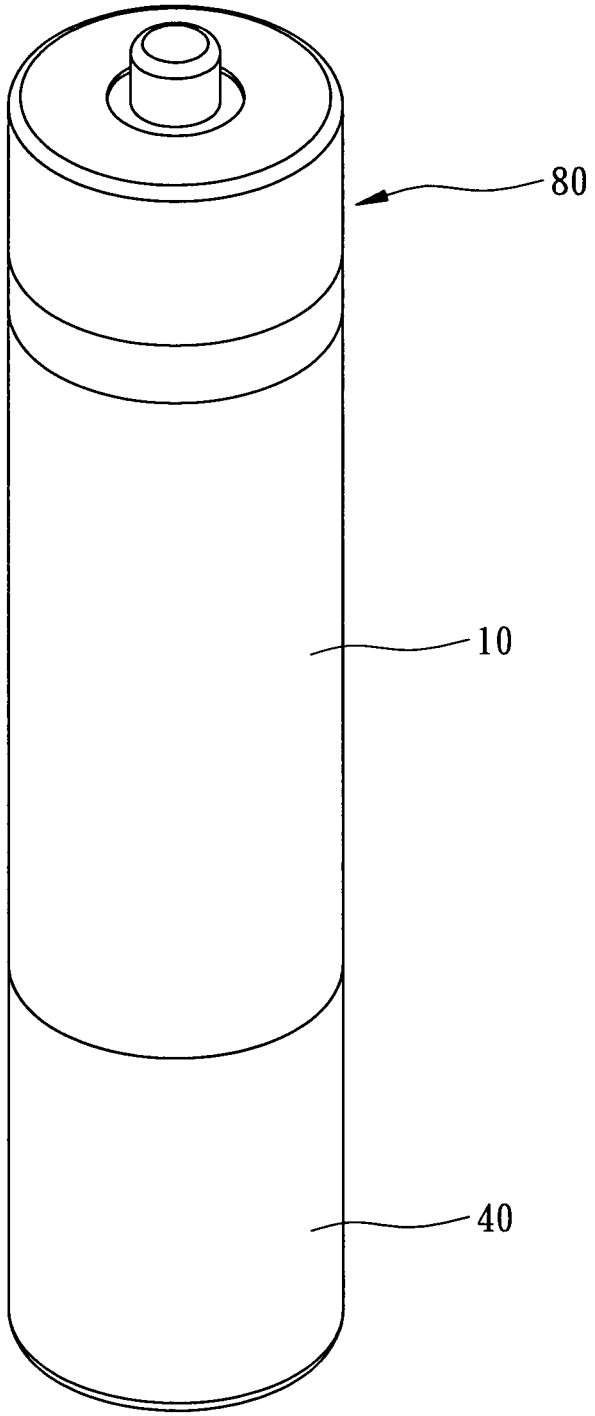
FIG. 6 is a perspective view of a second embodiment of the liquid dispenser in accordance with the present invention.
Figure 7:
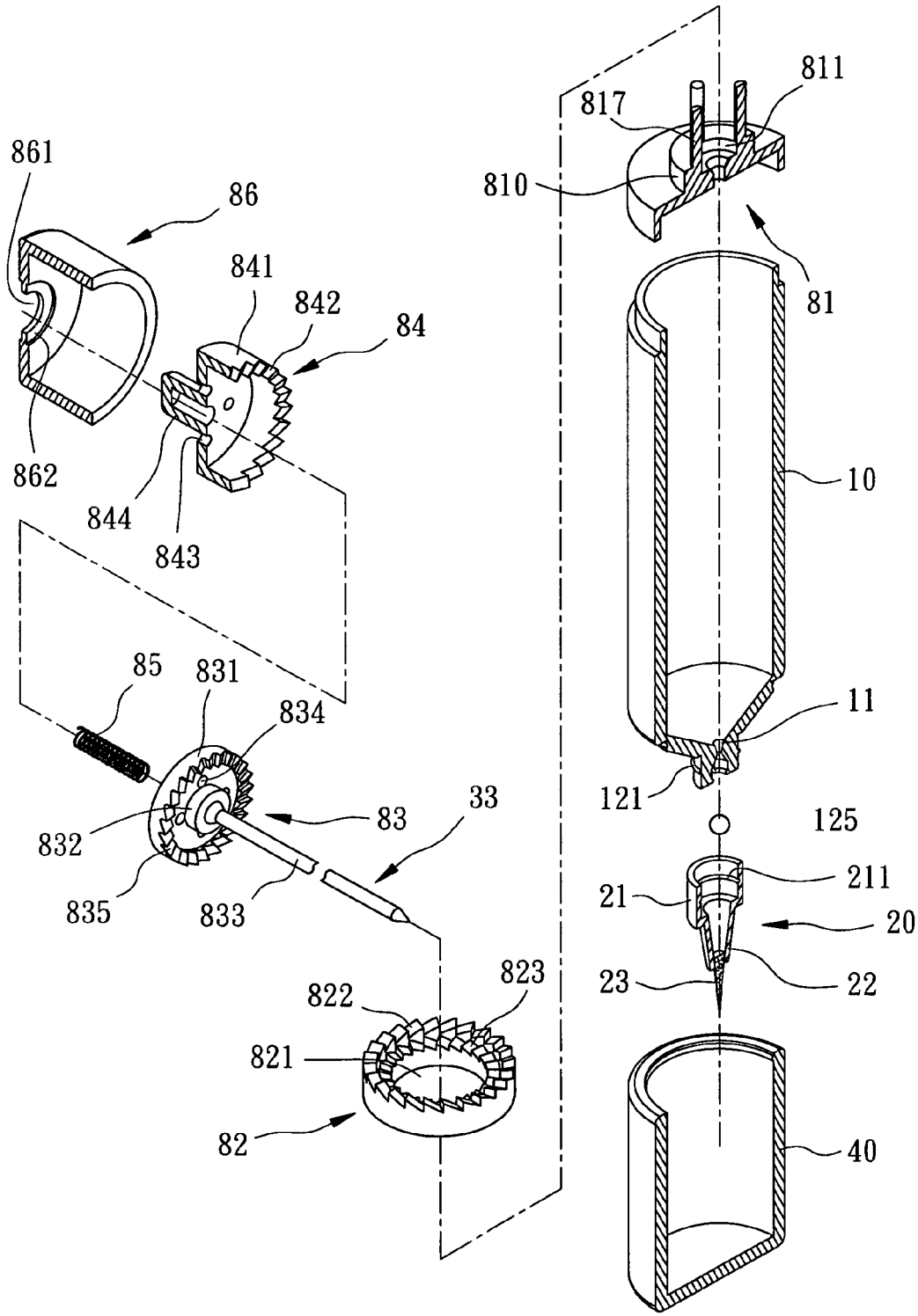
FIG. 7 is an exploded perspective view of the liquid dispenser in FIG. 6.
Figure 8:
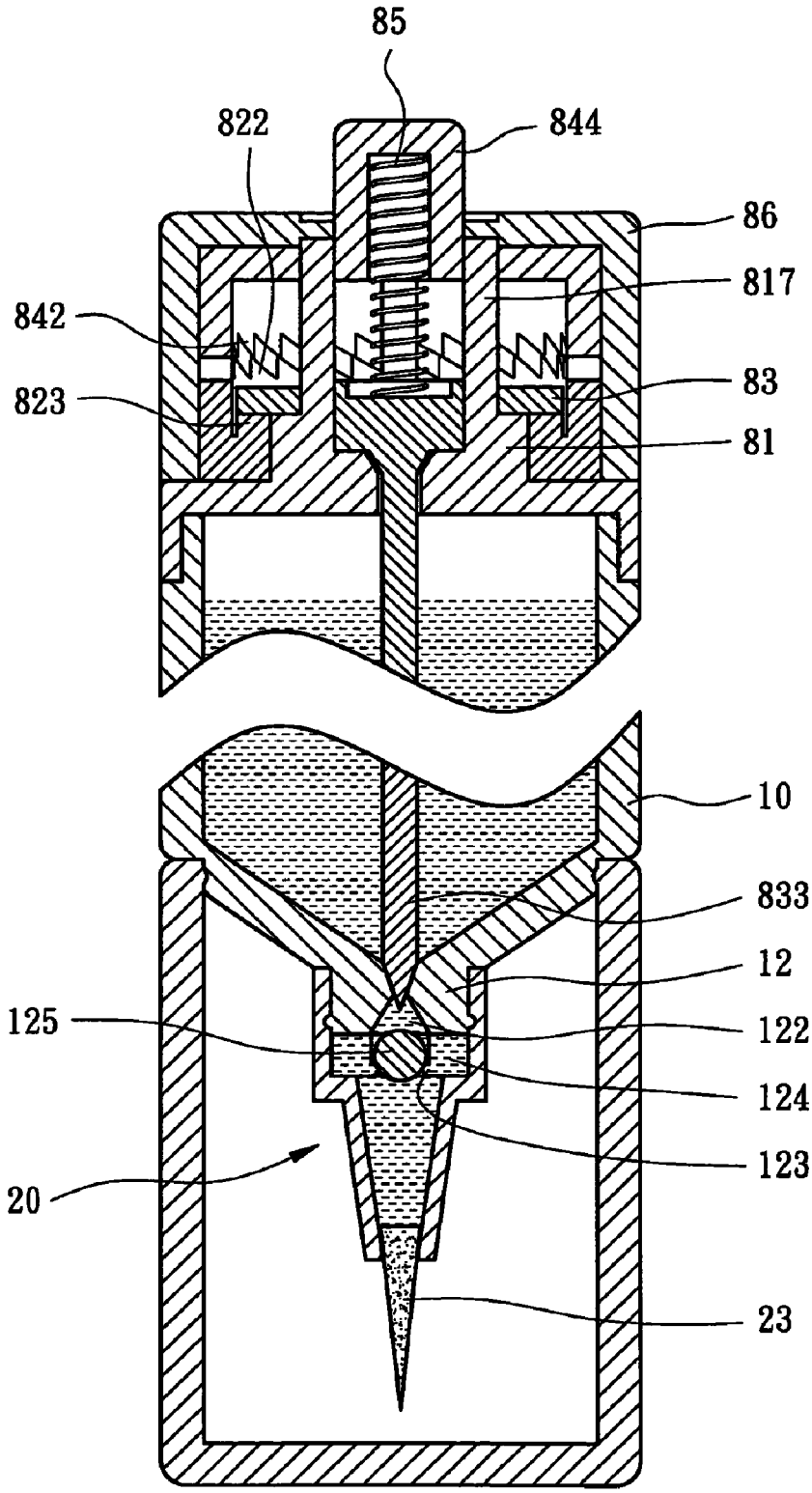
FIG. 8 is a cross-sectional view of the liquid dispenser in FIG. 6.

With reference to FIGS. 6-8 that show a second embodiment of the control device (80) of the liquid dispenser in accordance with the present invention, in this embodiment, the control device (80) includes a guider (81) co-axially mounted to the second end of the hollow shank (10) and airtightly closing the second end of the hollow shank (10). The guider (81) has a protrusion (810) centrally extending therefrom opposite to the hollow shank (10). AT-shaped hole (811) is centrally defined in the guider (81) and extends through the guider (81). The T-shaped hole (811) includes a first section and a second section, wherein the first section has a diameter greater than that of the second section. Multiple rods (817) perpendicularly extend from the protrusion (810) and correspond to an axis of the guider (81).

An actuator (82) rotatably mounted on the guider (81). The actuator (82) has a central hole (821) defined therein for receiving the protrusion (810). The actuator (82) includes an outer ratchet ring (822) and an inner ratchet ring (823) respectively formed on one side of the actuator (82) opposite to the guider (81) wherein the ratchet direction of the outer ratchet ring (822) is opposite to that of the inner ratchet ring (823).

A pusher (83) is longitudinally mounted to the actuator (82). The pusher (83) has a disk (831) rotatably and partially received in the actuator (82). A block (832) centrally extends from the disk (831) and is movably received in the first section of the T-shaped hole (811). A needle (833) centrally extends from the block (832) and extends through the second section of the T-shaped hole (811). The needle (833) is formed with a tapered free end that is selectively received in the first tapered hole (11) for closing the passage that is defined in the first end of the hollow shank (10). The disk (831) has multiple through holes (834) defined therein and surrounding the block (832). Each through hole (834) aligns with a corresponding one of the multiple rods (817) to allow the multiple rods (817) extending through the disk (831) such that the disk (831) can only be longitudinally moved relative to the guider (81). A first ratchet ring (835) is formed on the disk (831) and complementally engaged with the inner ratchet ring (823).

A drive element (84) is co-axially mounted to the actuator (82). The drive element (84) includes a cylindrical portion (841) having a diameter equal to that of the outer ratchet ring (822). The cylindrical portion (841) has a closed end and an open end. A second ratchet ring (842) is formed on a distal edge of the open end of the cylindrical portion (841). The second ratchet ring (842) is overlapped relative to the outer ratchet ring (822) and complementally corresponds to the outer ratchet ring (822). The second ratchet ring (842) is separated from the outer ratchet ring (822) when the drive element (84) is in a free condition. The drive element (84) has multiple through holes (843) defined in the closed end of the cylindrical portion (841) to allow the multiple rods (817) of the guider (81) extending through the drive element (84) such that the drive element (84) can only be longitudinally moved relative to the guider (81). A hollow rod (844) co-axially extends from the close end of the cylindrical portion (841). A resilient member (85) is pre-compressed and mounted between the pusher (83) and the drive element (84) to make the second ratchet ring (842) being separated from the outer ratchet ring (822) when the drive element (84) is in a free condition. In preferred embodiment of the present invention, the resilient member (85) is a compression spring and partially received in the hollow rod (844). A cap (86) is co-axially and securely mounted to the guider (81) for movably receiving the drive element (84). The cap (86) has a through hole (861) defined therein for allowing the hollow rod (844) extending through the cap (86). An annular groove (862) is defined in the cap (86) and surrounds the through hole (861) in the cap (86), wherein the free end of each of the multiple rods (817) is received in the annular groove (862) when the cap (86) is mounted to the guider (81).

Figure 9:
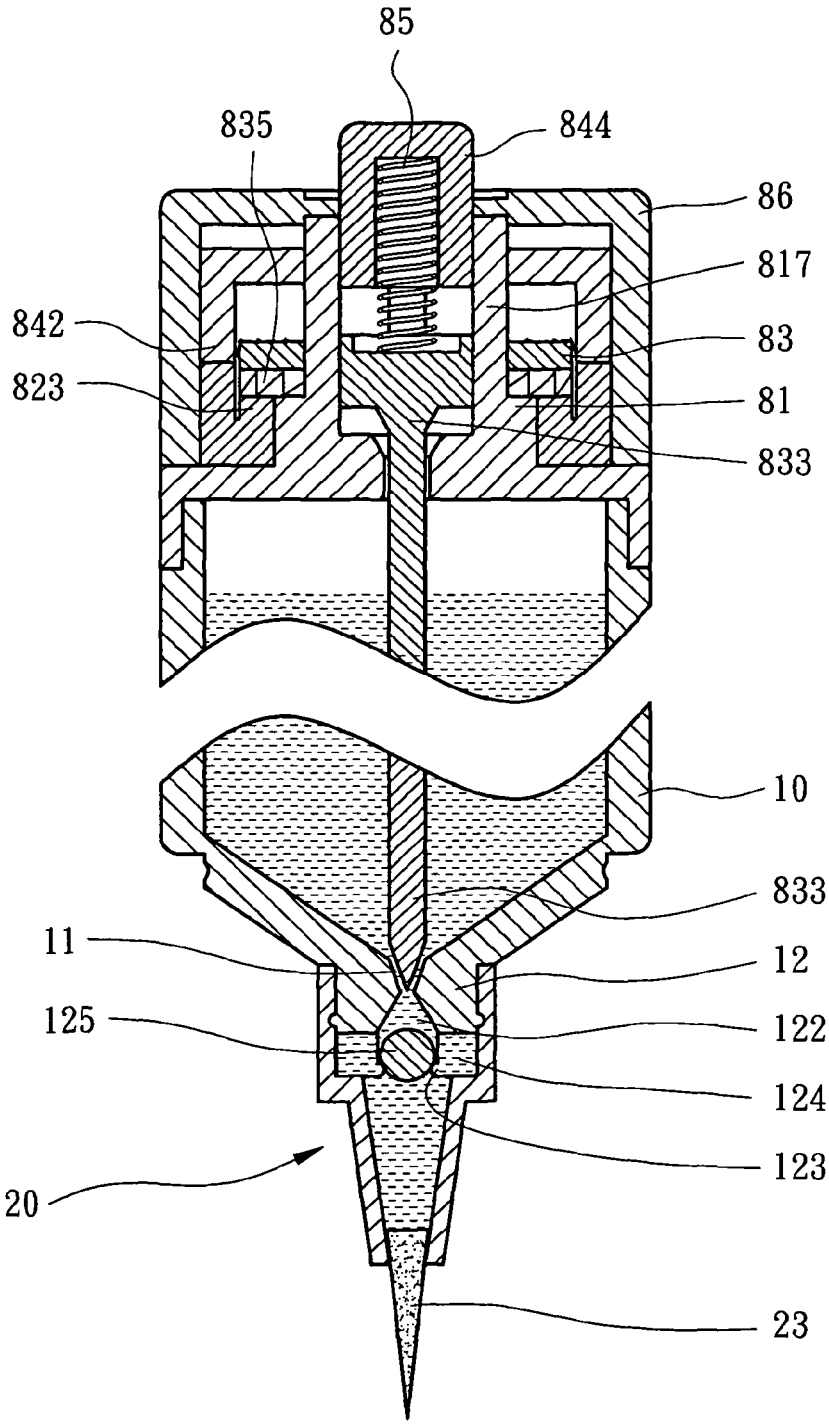
FIG. 9 is an operational view of the liquid dispenser in FIG. 6.

With reference to the FIGS. 8 and 9, the drive element (84) is moved toward the actuator (82) and rotates the actuator (82) due to the complementally corresponded second ratchet ring (842) and the outer ratchet ring (822) when the hollow rod (844) is pressed. At the same time, the rotated actuator (82) pushes the pusher (83) to make the disk (831) with the needle (833) moved toward the cap (86) and compress the resilient member (85) due to the engaged inner ratchet ring (823) and the first ratchet ring (835) such that the tapered free end of the needle (833) is separated from the first tapered hole (11). Consequently, the air flows into the hollow shank (10) via the T-shaped hole (811). As a result, the liquid, in the hollow shank (10), flows into the dispensing head (20) via the first tapered hole (11), the second tapered hole (122) and the slots (124). Finally, the liquid is output by the dispensing element (23). The first ratchet ring (835) reversely rotates the actuator (82) with the inner ratchet ring (823) and the disk (831) moved toward the hollow shank (10) due to the restitution force of the resilient member (85) when the hollow rod (844) is released. The first tapered hole (11) is closed again by the tapered free end of the needle (833) when the first ratchet ring (835) is complementally engaged with the inner ratchet ring (823) due to the restitution force of the resilient member (85).

Figure 10:
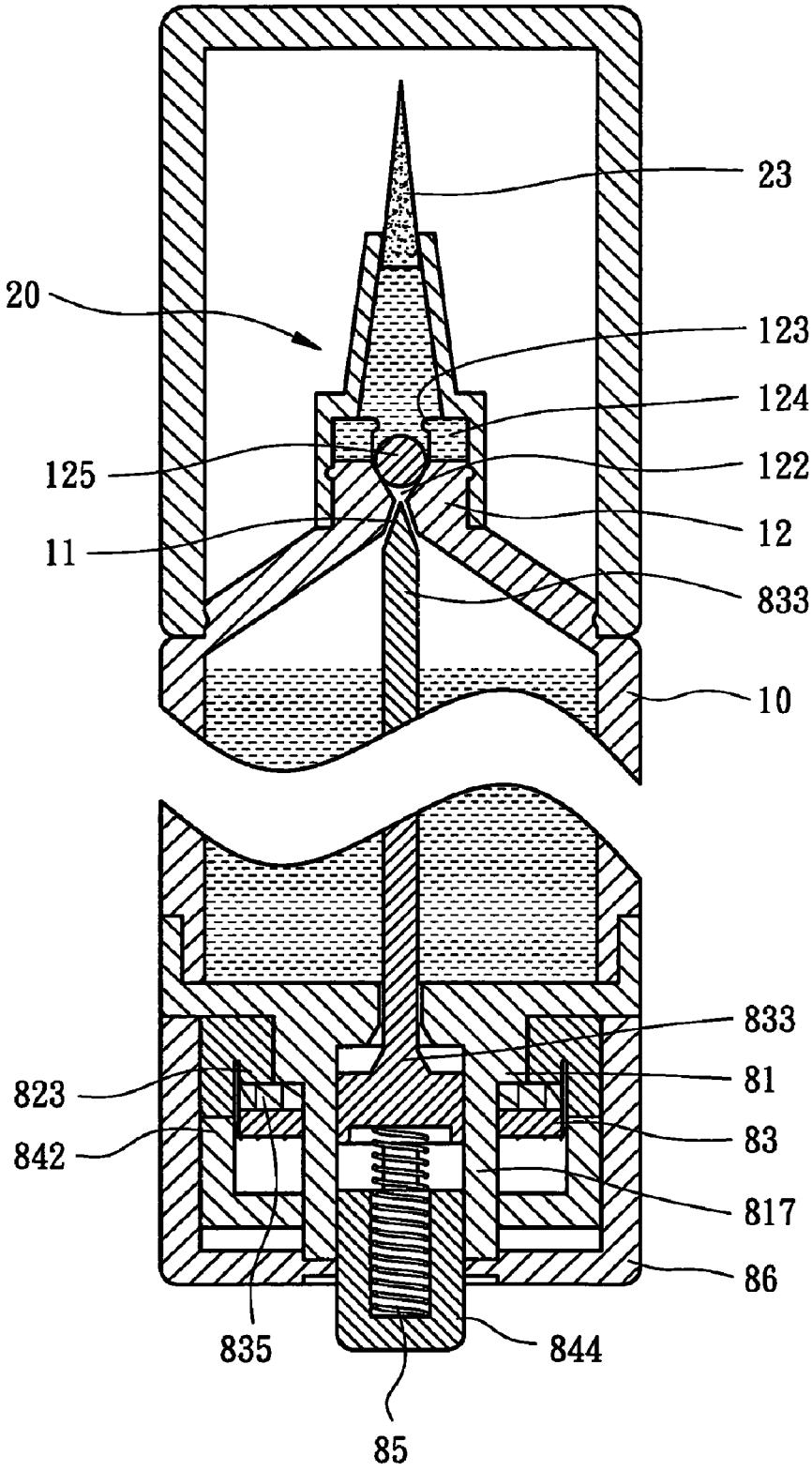
FIG. 10 is another operational view of the liquid dispenser in FIG. 6.

With reference to FIG. 10, the steel ball (125) abuts against an inner periphery of the second tapered hole (122) to close the passage defined in the first end of the hollow shank (10) when the hollow shank (10) is reversed and the control device (80) is operated in error. Consequently, the remained liquid in the dispensing head (20) can not flow back into the hollow shank (10) and the remained liquid in the hollow shank (10) can not flow out of the hollow shank (10) via the T-shaped hole (311) in the guider (31) because the air can not flow into the hollow shank (10).

Although the invention has been explained in relation to its preferred embodiment, it is to be understood that many other possible modifications and variations can be made without departing from the spirit and scope of the invention as hereinafter claimed.

What is claimed is:

1. A liquid dispenser comprising:

a hollow shank for containing liquid, the hollow shank having a first end that is closed and a second end that is open, a first tapered hole centrally defined in the first end of the hollow shank and communicating with an inner periphery of the hollow shank, a connector co-axially and outwardly extending from the first end of the hollow shank, a second tapered hole longitudinally defined in the connector and communicating with the first tapered hole, an annular rib inward extending from a distal edge of the second tapered hole, multiple slots radially defined in a free end of the connector and communicating with the second tapered hole, a steel ball movably received in the second tapered hole for selectively closing the second tapered hole and having a diameter greater than an inner diameter of the annular rib to prevent the steel ball from detaching from the connector;

a dispensing head longitudinally mounted to the connector for dispensing liquid from the hollow shank, the dispensing head including an engaging portion sleeved on the connector and a connecting portion longitudinally extending from the engaging portion for mounting a dispensing element;

a control device longitudinally mounted to the second end of the hollow shank for selectively opening/closing the first tapered hole; and a sheath detachably mounted to the first end of the hollow shank for protecting the dispensing head after use.

2. The liquid dispenser as claimed in claim 1, wherein the control device includes guider co-axially mounted to the second end of the hollow shank and airtightly closing the second of the hollow shank, the guider including:

a protrusion centrally extending from the guider opposite to the hollow shank;

a T-shaped hole centrally defined in the guider and extending through the guider, the T-shaped hole including a first section and a second section, wherein the first section has a diameter greater than that of the second section; and multiple rods perpendicularly extending from the protrusion and corresponding to an axis of the guider.

3. The liquid dispenser as claimed in claim 2, wherein the control device includes a drive ring longitudinally and rotatably mounted to the second end of the hollow shank, the drive ring having a first ratchet ring radially extending from an inner periphery thereof and surrounding the protrusion of the guider.

4. The liquid dispenser as claimed in claim 3, wherein the control device includes a pusher longitudinally mounted to the guider and including:

a disk rotatably and co-axially received in the drive ring;

a block centrally extending from the disk and rotatably received in the first section of the T-shaped hole;

a needle centrally extending from the block and extending through the second section of the T-shaped hole, the needle formed with a tapered free end that is selectively received in the first tapered hole for selectively closing the first tapered hole;

multiple through holes defined in the disk and surrounding the block, each through hole aligning with a corresponding one of the multiple rods to allow the multiple rods extending through the disk to prevent the disk from being rotated relative to the guider; and a second ratchet ring formed on the disk and complementally engaged with the first ratchet ring.

5. The liquid dispenser as claimed in claim 4, wherein the control device includes a cover mounted to a free end of each of the multiple rods to prevent the drive ring and the pusher from detaching from the guider, a resilient being pre-compressed and member mounted between the disk and the cover to ensure that the first ratchet ring and the second ratchet ring are complementally engaged with each other, and the tapered free end of the needle is received in the first tapered hole for closing the first tapered hole before the drive ring being rotated.

6. The liquid dispenser as claimed in claim 5, wherein the drive ring has an annular groove defined in a distal end thereof opposite to the hollow shank for receiving the cover.

7. The liquid dispenser as claimed in claim 2, wherein the control device includes an actuator rotatably mounted on the guider, the actuator including a central hole defined in the actuator for receiving the protrusion, a outer ratchet ring and an inner ratchet ring respectively formed on one side of the actuator opposite to the guider, wherein the ratchet direction of the outer ratchet ring is opposite to that of the inner ratchet ring.

8. The liquid dispenser as claimed in claim 7, wherein the control device includes a pusher longitudinally mounted to the guider and including:

a disk rotatably and co-axially received in the drive ring;

a block centrally extending from the disk and rotatably received in the first section of the T-shaped hole;

a needle centrally extending from the block and extending through the second section of the T-shaped hole, the needle formed with a tapered free end that is selectively received in the first tapered hole for selectively closing the first tapered hole;

multiple through holes defined in the disk and surrounding the block, each through hole aligning with a corresponding one of the multiple rods to allow the multiple rods extending through the disk to prevent the disk from being rotated relative to the guider; and a first ratchet ring formed on the disk and complementally engaged with the inner ratchet ring.

9. The liquid dispenser as claimed in claim 8, wherein the control device includes a drive element co-axially mounted to the actuator and including:

a cylindrical portion having a diameter equal to that of the outer ratchet ring, the cylindrical portion having a closed end and an open end, a second ratchet ring formed on a distal edge of the open end of the cylindrical portion, the second ratchet ring overlapped relative to the outer ratchet ring and complementally corresponding to the outer ratchet ring, the second ratchet ring being separated from the outer ratchet ring when the drive element is in a free condition;

multiple through holes respectively defined in the closed end of the cylindrical portion allow the multiple rods of the guider extending through the drive element such that the drive element can only be longitudinally moved relative to the guider; and a hollow rod co-axially extending from the closed end of the cylindrical portion.

10. The liquid dispenser as claimed in claim 9, wherein the control device includes a resilient member being pre-compressed and mounted between the pusher and the drive element to make the second ratchet ring being separated from the outer ratchet ring and ensure that the first ratchet ring is engaged to the inner ratchet ring when the drive element is in a free condition.

11. The liquid dispenser as claimed in claim 10, wherein the control device includes a cap co-axially mounted to the guider for movably receiving the drive element, the cap having a through hole defined therein for allowing the hollow rod extending through the cap.

12. The liquid dispenser as claimed in claim 11, wherein the cap includes an annular groove defined in the cap and surrounding the through hole in the cap, wherein the free end of each of the multiple rods of the guider is received in the annular groove.

* * * * *